US010278499B2

(12) United States Patent
McElveen

(10) Patent No.: US 10,278,499 B2
(45) Date of Patent: May 7, 2019

(54) DRAWER SLIDE ASSEMBLY AND METHOD OF USE

(71) Applicant: Hardware Resources, Inc., Bossier City, LA (US)

(72) Inventor: Travis McElveen, Bossier City, LA (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

(21) Appl. No.: 15/181,883

(22) Filed: Jun. 14, 2016

(65) Prior Publication Data

US 2017/0007020 A1 Jan. 12, 2017

Related U.S. Application Data

(60) Provisional application No. 62/189,037, filed on Jul. 6, 2015.

(51) Int. Cl.
*A47B 88/493* (2017.01)
*A47B 88/483* (2017.01)

(52) U.S. Cl.
CPC ..... *A47B 88/493* (2017.01); *A47B 88/483* (2017.01); *A47B 2210/0035* (2013.01)

(58) Field of Classification Search
CPC ..... A47B 88/493; A47B 88/483; A47B 2210/0035
USPC ..... 312/333, 334.46
See application file for complete search history.

(56) References Cited

U.S. PATENT DOCUMENTS 6,851,773 B2 * 2/2005 Chen ..... A47B 88/493 312/333
6,997,611 B2 * 2/2006 Chen ..... A47B 88/493 312/333
2004/0080245 A1 * 4/2004 Lammens ..... A47B 88/49 312/333
2004/0145285 A1 * 7/2004 Hwang ..... A47B 88/493 312/333
2004/0174103 A1 * 9/2004 Yang ..... A47B 88/467 312/334.46
2006/0163983 A1 * 7/2006 Wu ..... A47B 88/493 312/333
2006/0244349 A1 * 11/2006 Chen ..... A47B 88/493 312/334.47
2007/0058888 A1 * 3/2007 Chen ..... A47B 88/493 384/19
2007/0182294 A1 * 8/2007 Hung ..... A47B 88/493 312/334.46
2009/0243450 A1 * 10/2009 Weng ..... A47B 88/493 312/334.1

(Continued)

*Primary Examiner* — Eret C McNichols
(74) *Attorney, Agent, or Firm* — Schultz & Associates, P.C.

(57) ABSTRACT

A full extension ball bearing drawer slide assembly comprised of a cabinet rail attached to a cabinet piece, an intermediate rail slidingly engaged with the cabinet rail via bearing runners, a drawer rail slidingly engaged with the intermediate rail via a bearing cage, and a cage hold forward device for advantageously positioning the bearing cage for ease of re-insertion of the drawer rail within the intermediated rail. The cage hold forward device is attached to the intermediate rail and comprises a protrusion for engagement with a flexible trigger mounted on the drawer rail and a flexible clip for releasable engagement with the bearing cage.

14 Claims, 14 Drawing Sheets

(56) References Cited

U.S. PATENT DOCUMENTS

| | | | | |
|---|---|---|---|---|
| 2013/0058596 | A1* | 3/2013 | Chen | F16C 29/005 384/7 |
| 2013/0058597 | A1* | 3/2013 | Chang | F16C 29/005 384/21 |
| 2014/0203697 | A1* | 7/2014 | Wada | G03G 21/1633 312/333 |
| 2014/0312755 | A1* | 10/2014 | Nuckolls | A47B 88/463 312/333 |
| 2015/0048730 | A1* | 2/2015 | Lowe | A47B 88/08 312/319.1 |
| 2017/0159710 | A1* | 6/2017 | Chen | F16C 43/04 |
| 2017/0254586 | A1* | 9/2017 | Hwang | A47B 88/473 |

* cited by examiner

DRAWER SLIDE ASSEMBLY AND METHOD OF USE

CROSS-REFERENCE TO RELATED APPLICATIONS

This application claims the benefit of U.S. Provisional Patent Application No. 62/189,037 filed on Jul. 6, 2015, the contents of which are incorporated herein by reference.

FIELD OF THE DISCLOSURE

The present disclosure relates to sliding assemblies for mounting drawers in cabinetry. In particular, the disclosure relates to full extension ball bearing slides with a cage hold device which controls the position of the ball bearings of the slide.

BACKGROUND OF THE DISCLOSURE

For many years, drawers have been suspended in cabinet carcasses by telescoping slides. These telescoping slides have ball bearings that facilitate their motion, but can complicate installation and maintenance. The disclosed device is a drawer slide assembly which includes a cage hold forward that acts to prevent the ball bearings from becoming dislodged from the slide assembly when the drawer is removed, as well as holding the bearings at the forward end of the slide to ease replacement of the drawer.

There is a need for a less complicated drawer slide assembly which provides ease of installation and provides restricted movement of a ball bearing cage in order to position the ball bearing cage advantageously at the forward end of the cabinet slide in order to ease placement of the drawer slide in the drawer slide assembly.

SUMMARY OF THE DISCLOSURE

In a preferred embodiment an extension ball bearing drawer slide assembly with a cage hold forward device comprises a cabinet rail telescopically engaged with an intermediate rail which is telescopically engaged with a drawer rail. Ball bearing runners provide slidable engagement between the cabinet rail and the intermediate rail while a bearing cage provides slidable engagement between the intermediate rail and the drawer rail. A cage hold forward device attached to an end of the intermediate rail has a flexible clip which abuts with the bearing cage. A raised block is provided which engages with a flexible trigger mounted to the drawer rail. An end block attached to an end of the cabinet rail which engages with both the intermediate and cabinet rails.

In use, the cabinet rail is mounted to a cabinet carcass. The drawer rail is mounted to a drawer. When opening the drawer, the drawer rail moves in the opening direction until the trigger engages the raised end block of the cage hold forward device. Pulling the trigger allows the drawer rail to move past the cage hold forward device and allows the drawer to be completely removed from the cabinet carcass. The drawer rail pulls the bearing cage towards the cage hold forward device as the drawer is removed. The flexible clip of cage hold forward device releasably engages the bearing cage and positions the bearing cage at the forward end of the intermediate rail such that upon re-insertion of the drawer into the cabinet carcass, the drawer rail immediately engages the bearing cage to ease the re-insertion. The flexible trigger engages the flexible clip which releases the bearing cage from engagement with the cage hold forward device.

Those skilled in the art will appreciate the above-mentioned features and advantages of the disclosure together with other important aspects upon reading the detailed description that follows in conjunction with the drawings provided.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
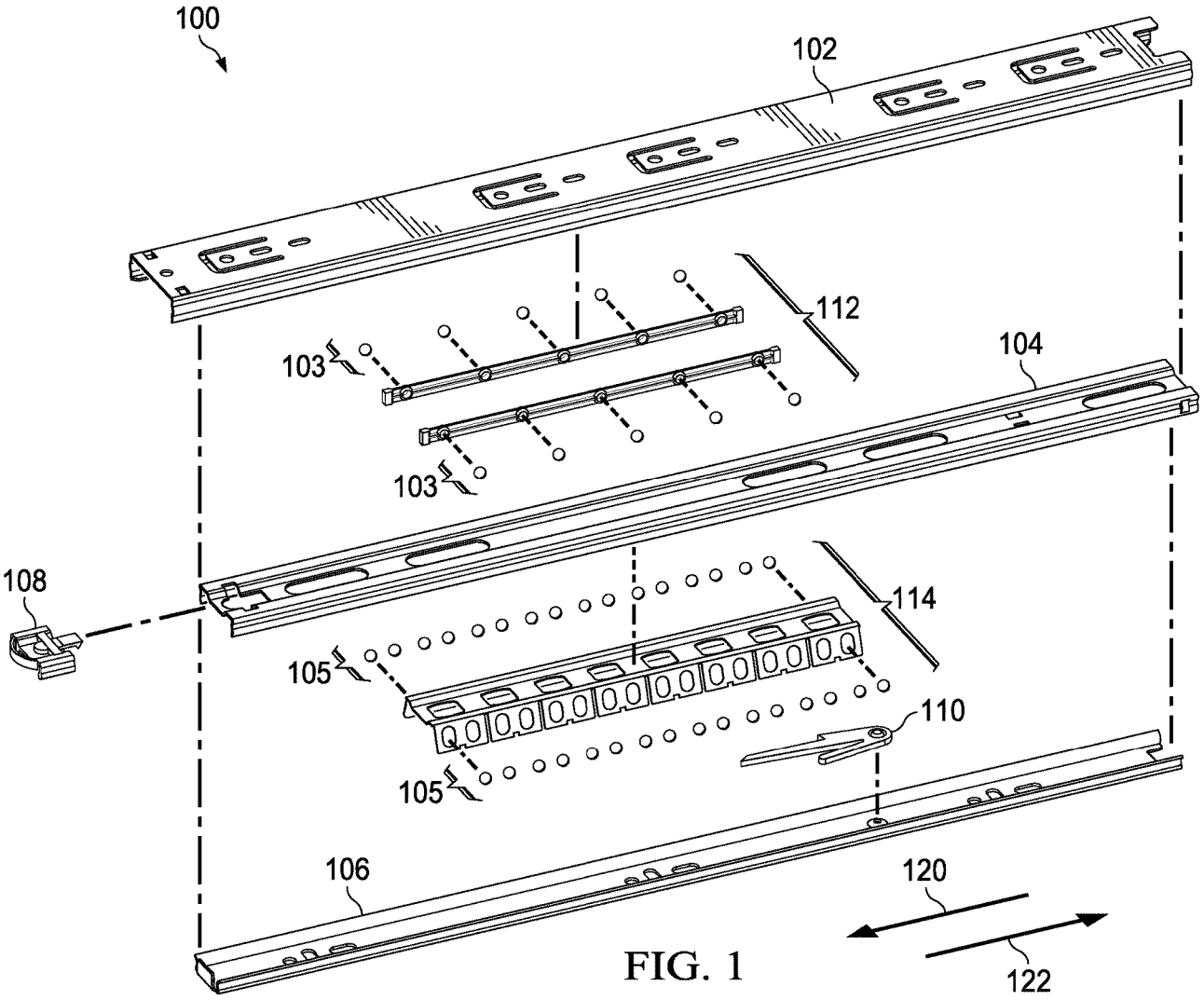
FIG. 1 is an exploded isometric view of a preferred embodiment of a drawer slide assembly.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Referring to FIG. 1, drawer slide assembly 100 is comprised of cabinet rail 102, intermediate rail 104, drawer rail 106, cage hold forward device 108, and flexible trigger 110. Bearing runners 112 slide between cabinet rail 102 and intermediate rail 104. Each bearing runner has a generally flat body with holes for bearings 103. Bearing cage 114 slides between intermediate rail 104 and drawer rail 106 and has holes for bearings 105. Each rail 102, 104, and 106 of drawer slide assembly 100 is generally C-shaped and includes grooves for housing the bearing runners or bearing cage. Cabinet rail 102 is mounted to the inside of the cabinet frame of a furniture piece having a drawer while drawer rail 106 is mounted to the drawer using common attachment hardware such as wood screws. The three rails are telescopically engaged with one another. Drawer rail 106, intermediate rail 104, bearing runners 112, and bearing cage 114 slide in direction 120 during an opening movement and direction 122 during a closing movement of the drawer.

Figure 2A:
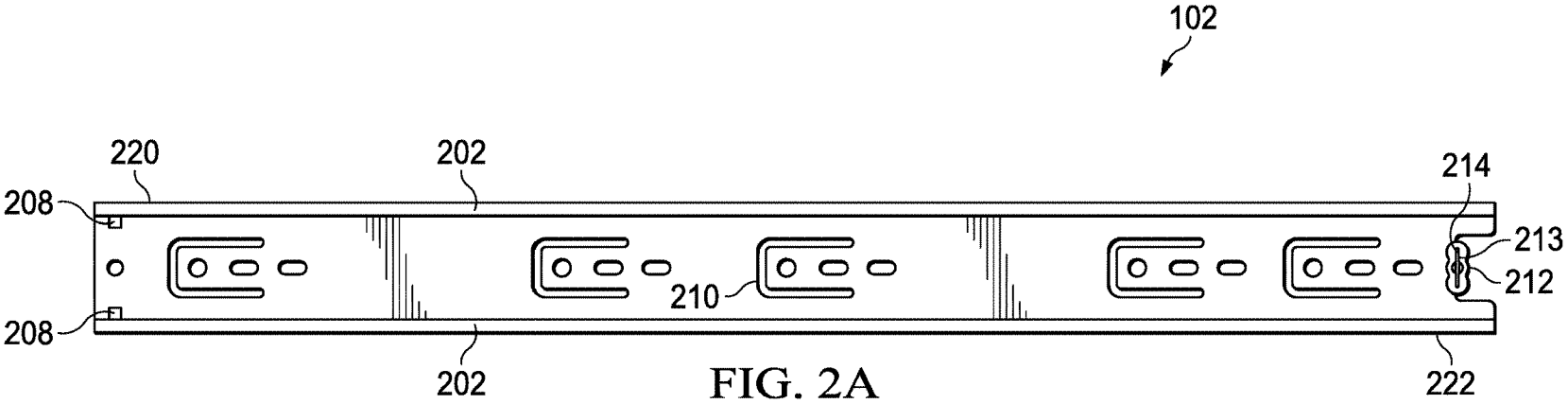
FIG. 2A is a plan view of a preferred embodiment of a cabinet rail.
Figure 2B:
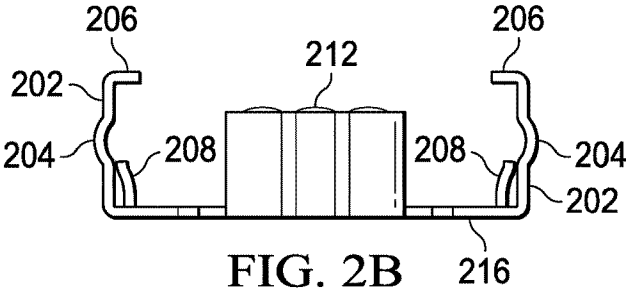
FIG. 2B is an end view of a preferred embodiment of a cabinet rail.

Referring to FIGS. 2A and 2B, cabinet rail 102 is shown. Cabinet rail 102 is formed by edges 202 extending from web 216. Edges 202 run the length of cabinet rail 102 from end 220 to end 222. Each edge 202 has a curved shape that forms inner groove 204. The inner groove functions as a bearing race. Each edge 202 also includes overhang 206. Flange 214 extends perpendicularly from web 216 at end 222 of cabinet rail 102. End block 212 is frictionally attached to flange 214. In one embodiment, end block 212 is formed of rubber or similar deformable yet resilient material and is frictionally held in place on flange 214 via a slot 213 which flange 214 extends through. In other embodiments, end block 212 is formed of nylon or Teflon®. Proximate end 220 of cabinet rail 102 are tabs 208. Tabs 208 extend generally perpendicularly from web 216 adjacent edges 202 for engagement with bearing runner 112. Mounting holes 210 are spaced along the length of cabinet rail 102 through web 216.

Figure 3A:
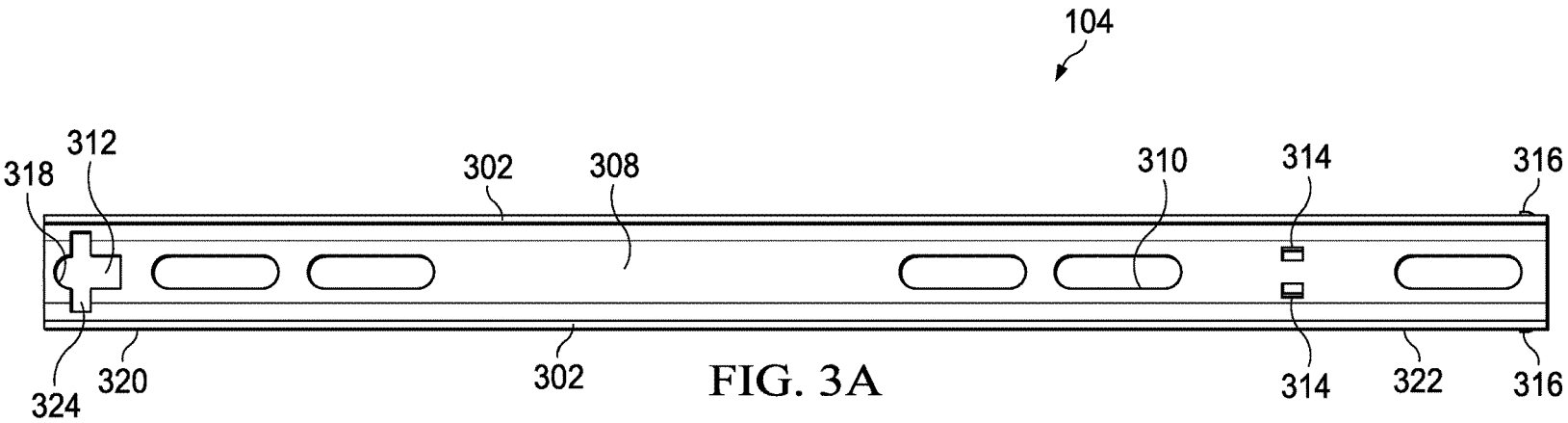
FIG. 3A is a plan view of a preferred embodiment of an intermediate rail.
Figure 3B:
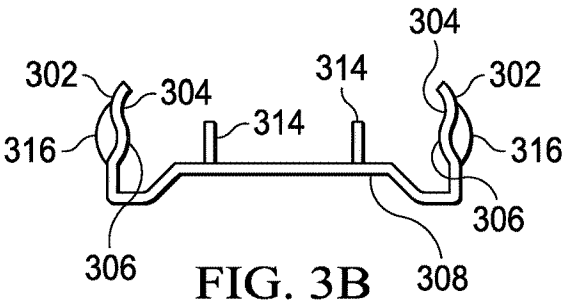
FIG. 3B is an end view of a preferred embodiment of an intermediate rail.

Referring to FIGS. 3A and 3B, intermediate rail 104 is shown. Intermediate rail 104 is slidingly engaged with cabinet rail 102 via bearing runners 112. Intermediate rail 104 has edges 302 extending from web 308. Edges 302 run the length of intermediate rail 104 from end 320 to end 322. Each edge 302 includes two curves that form inner groove 304 and outer groove 306. Both the inner groove and outer groove function as a bearing race. Stop tabs 316 extend from each side 302 in outer groove 306 at end 322 of intermediate slide 104. Mounting hole 312 is positioned in web 308 proximate end 320 of intermediate rail 104. Mounting hole 312 is generally T-shaped with curved forward edge 318 and cross bar edge 324. Mounting hole 312 is sized and shaped to receive cage hold forward device 108. Access holes 310 are spaced along the length of intermediate rail 104 through web 308. Tabs 314 extend from web 308 towards the interior of intermediate rail 104. Tabs 314 are located proximate end 322 of intermediate rail 104 between a pair of access holes 310.

Figure 4A:
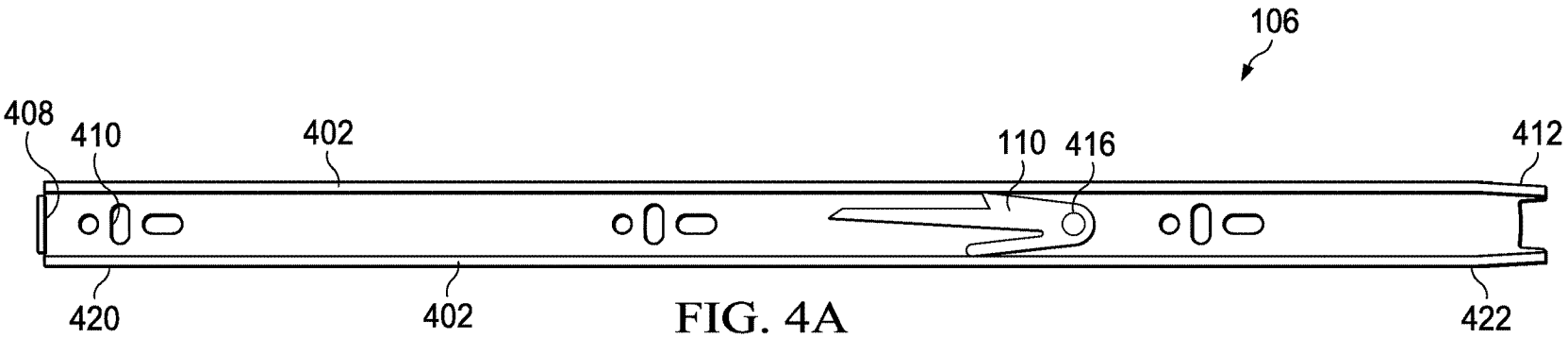
FIG. 4A is a plan view of a preferred embodiment of a drawer rail.
Figure 4B:
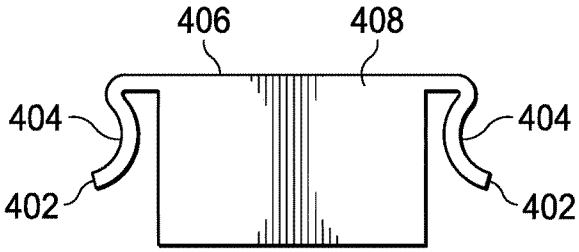
FIG. 4B is an end view of a preferred embodiment of a drawer rail.

Referring to FIGS. 4A and 4B, drawer rail 106 is shown. Drawer rail 106 is slidingly engaged with intermediate rail 104 via bearing cage 114. Drawer rail 106 includes edges 402 extending from web 406. Each edge 402 includes a curved shape that forms outer groove 404. The outer groove functions as a bearing race. Edges 402 run the length of drawer rail 106 from end 420 to end 422. Edges 402 terminate at end 422 in pinch arms 412. Pinch arms 412 are slightly angled towards one another resulting in the distance between them being slightly less the width of end block 212. Flange 408 extends from web 406 towards the interior of drawer rail 106 at end 420. Mounting holes 410 are spaced along the length of drawer rail 106 through web 406. Flexible trigger 110 is pivotally attached with pin 416 to web 406 between a pair of mounting holes 410.

Figure 5A:
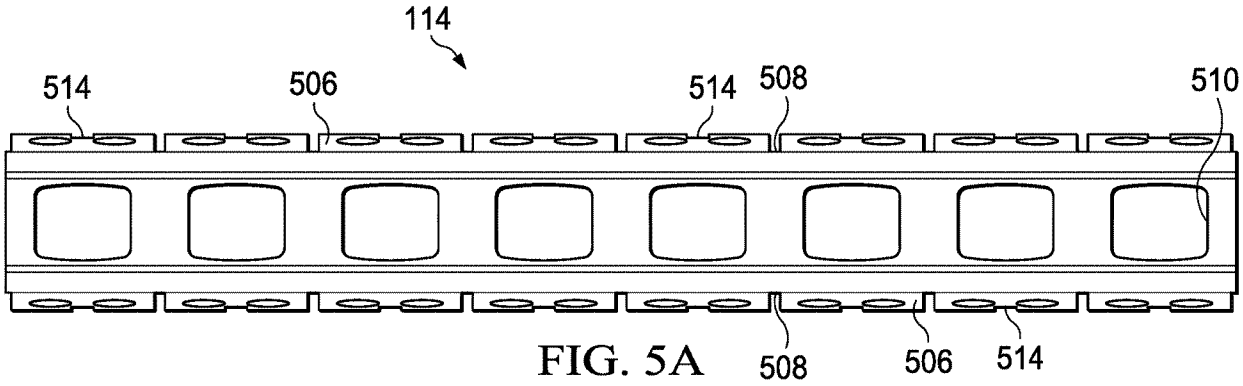
FIG. 5A is a plan view of a preferred embodiment of a bearing cage.
Figure 5B:
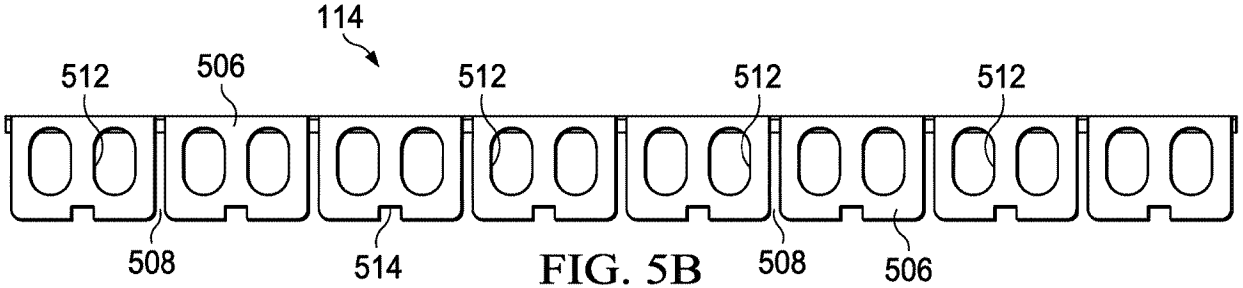
FIG. 5B is a side view of a preferred embodiment of a bearing cage.
Figure 5C:
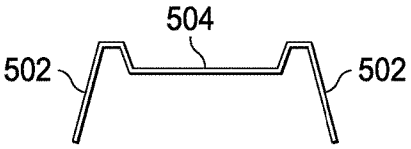
FIG. 5C is an end view of a preferred embodiment of a bearing cage.

Referring to FIGS. 5A, 5B, and 5C, bearing cage 114 is shown. Bearing cage 114 is formed by edges 502 extending from web 504. Edges 502 run the length of bearing cage 114. Each edge 502 is divided into segments 506 separated by gaps 508. Each segment 506 includes notches 514 on each edge 502. Each segment 506 also includes bearing holes 512. Bearing holes 512 are sized and shaped to retain ball bearings. Holes 510 are spaced along the length of bearing cage 114 through web 504.

Figure 6A:
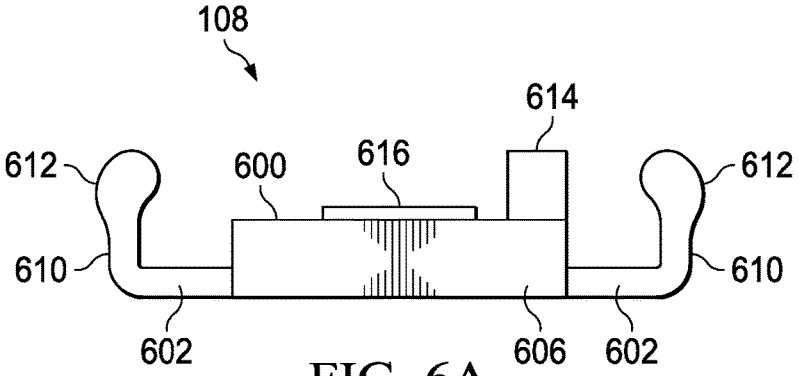
FIG. 6A is an end view of a preferred embodiment of a cage hold forward device.
Figure 6B:
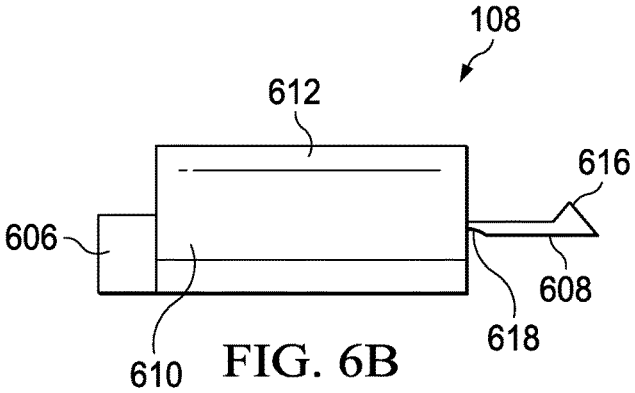
FIG. 6B is a side view of a preferred embodiment of a cage hold forward device.
Figure 6C:
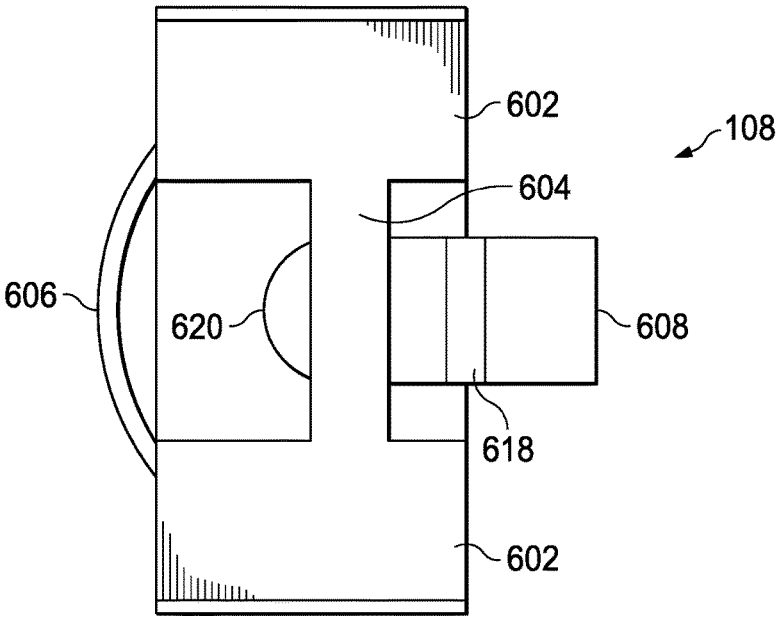
FIG. 6C is a plan view of a preferred embodiment of a cage hold forward device.

Referring to FIGS. 6A, 6B, and 6C, cage hold forward device 108 is shown. Cage hold forward device 108 comprises a generally rectangular body 600 having mounting bar 604 attached to sides 602. Bumper 606 arcs between sides 602. Edges 610 extend generally perpendicularly from sides 602. Edges 610 include globular shaped tips 612 shaped to follow inner grooves 304 of intermediate slide 104. Block 614 extends from body 600 and is positioned off-center proximate one side 602. Flexible clip 608 extends from body 600 opposite bumper 606. Flexible clip 608 includes a triangular shaped protrusion 616 on one side and notch 618 on an opposing side. Flexible clip 608 is capable of bending along notch 618 without breaking. Mounting bar 604 is sized and shaped to engage cross bar edge 324 while mounting curve 620 is sized and shaped to engage curved forward edge 318 of intermediate rail 104.

Figure 7:
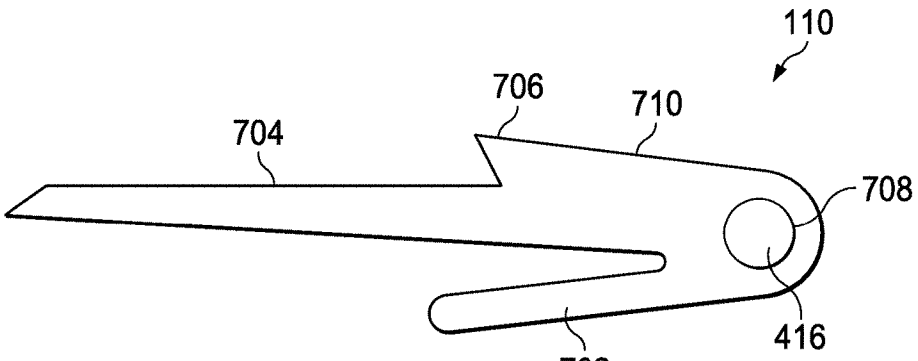
FIG. 7 is a plan view of a preferred embodiment of a trigger.

Referring to FIG. 7, trigger 110 is shown. Trigger 110 comprises flexible arm 702 attached to release arm 704. Flexible arm 702 is deformable and resilient acting as a spring. Release arm 704 includes catch 706 and angled surface 710. Catch 706 is sized to engage block 614. Mounting hole 708 provides a pivotal attachment point to drawer rail 106 via pin 416.

Figure 8:
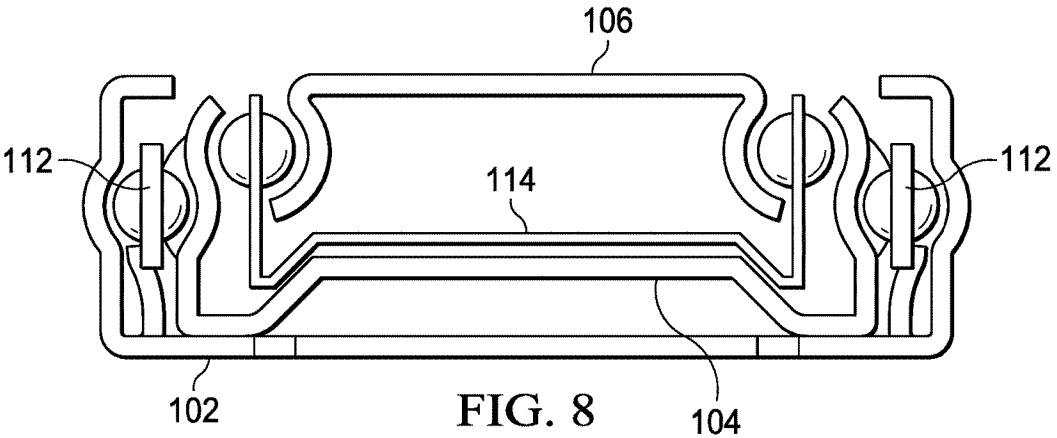
FIG. 8 is an end view of a preferred embodiment of a drawer slide assembly.

As shown in FIG. 8, the rails and bearings of drawer slide assembly 100 are positioned relative to each other as follows. Bearing runners 112 are slidingly disposed between inner groove 204 of cabinet rail 102 and outer groove 306 of intermediate rail 104. Intermediate rail 104 is slidingly disposed within cabinet rail 102 such that mounting hole 312 of intermediate rail 104 is opposite end block 212 of cabinet rail 102. Bearing cage 114 is slidingly disposed between intermediate rail 104 and drawer rail 106. The ball bearings contained in each bearing hole 512 of bearing cage 114 are positioned between inner groove 304 of intermediate rail 104 and outer groove 404 of drawer rail 106. Web 504 of bearing cage 114 is nested within web 308 of intermediate rail 104. Drawer rail 106 is slidingly disposed within bearing cage 114 such that trigger 700 faces web 504 and release arm 704 points away from pinch arms 412.

Figure 9A:
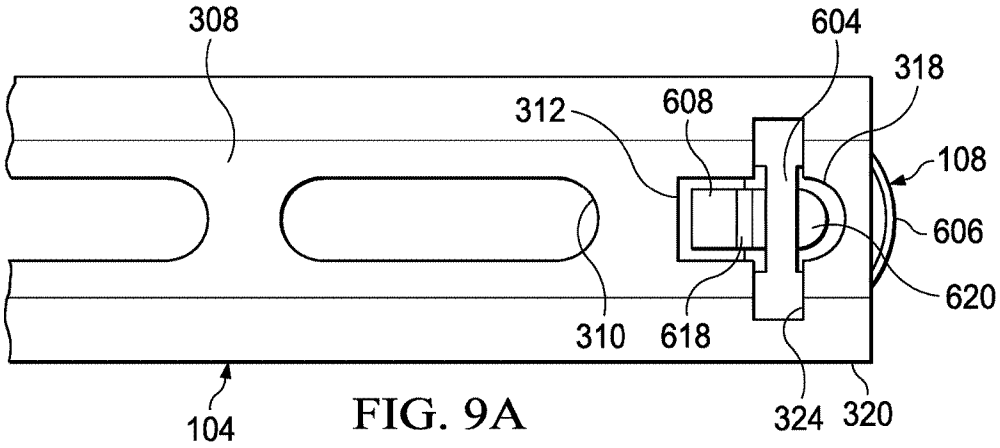
FIG. 9A is a partial plan view of a preferred embodiment the cage hold forward device attached to the intermediate rail.
Figure 9B:
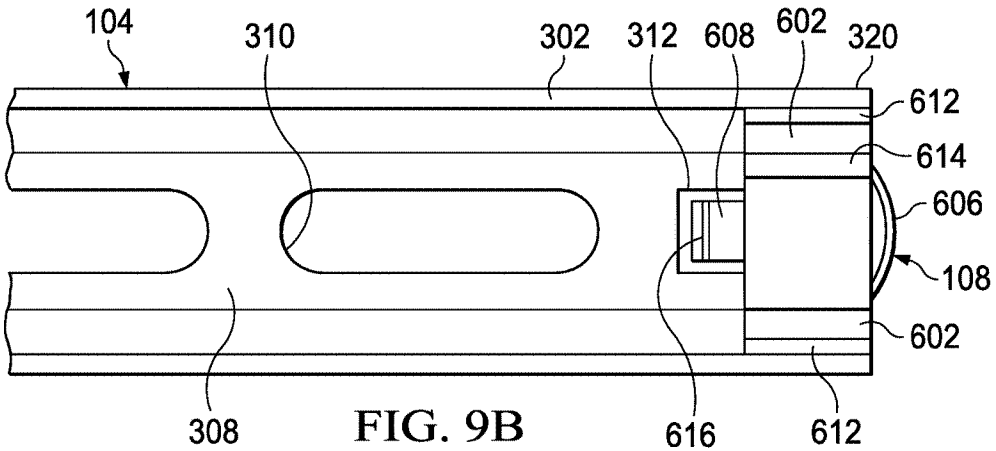
FIG. 9B is a partial plan view of a preferred embodiment the cage hold forward device attached to the intermediate rail.

As shown in FIGS. 9A and 9B, cage hold forward device 108 is attached to intermediate rail 104 such that mounting bar 604 engages cross bar edge 324, mounting curve 620 engages curved forward edge 318, and edges 610 and tips 612 engage edges 302 and inner grooves 304. Flexible clip 608 rests in mounting hole 312 such that it is mostly flush with web 308. Protrusion 616 extends through mounting hole 312 enough to engage bearing cage 114. Bumper 606 extends past end 320 of intermediate rail 104.

Figure 10A:
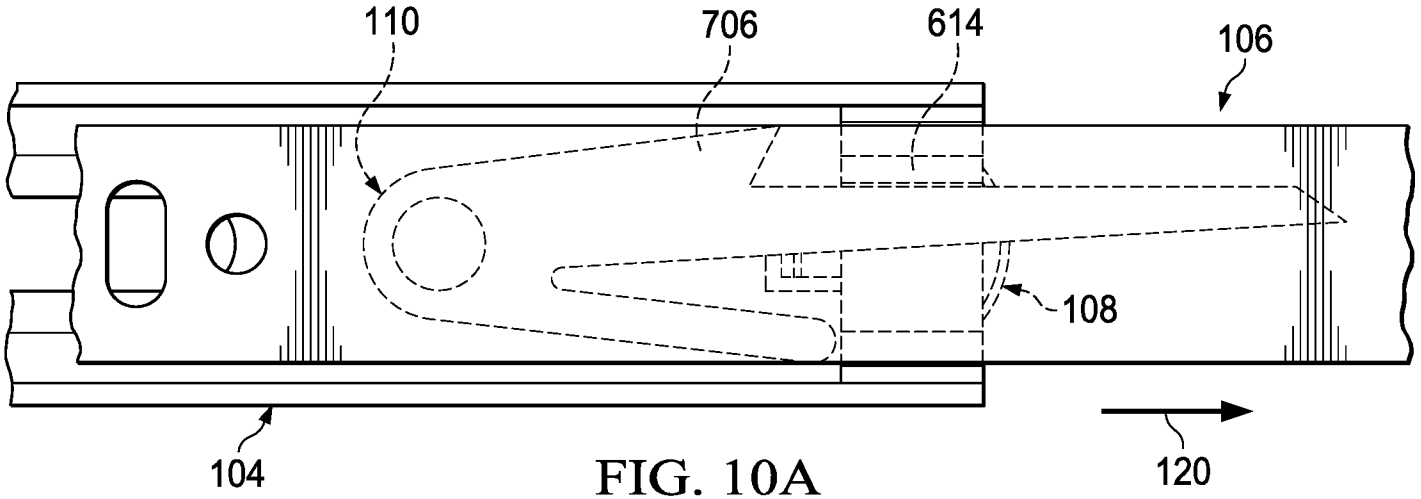
FIG. 10A is a partial plan view of a preferred embodiment the drawer rail in a fully opened position relative to the intermediate rail.

In use, the sliding motion of drawer rail 106 relative to intermediate rail 104 is limited by trigger 110 and cage hold forward device 108. As shown in FIG. 10A, when opening the drawer to which drawer side assembly 100 is mounted, trigger 110 connected to drawer rail 106 slides in direction 120 until catch 706 engages block 614. Drawer rail 106 is prevented from disengaging with intermediate rail 104 by catch 706 abutting block 614.

Figure 10B:
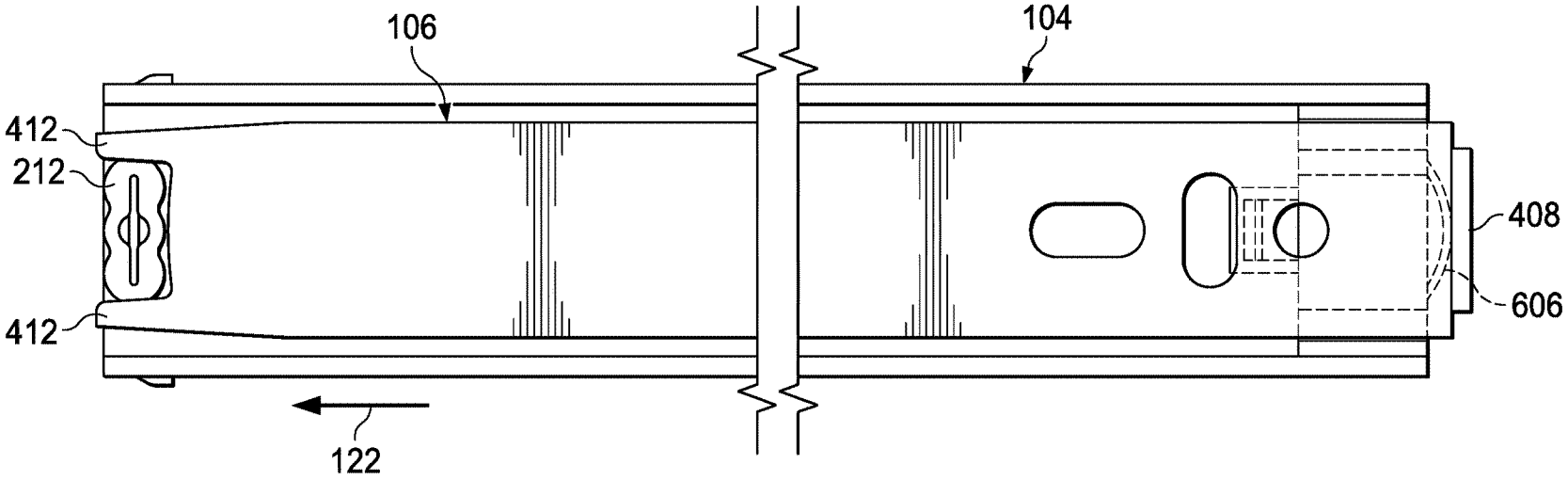
FIG. 10B is a partial plan view of a preferred embodiment the drawer rail in a fully closed position relative to the intermediate rail.

Referring also to FIG. 10B, when closing, drawer rail 106 slides in direction 122 until flange 408 abuts bumper 606. When drawer slide assembly 100 is fully closed, pinch arms 412 engage end block 212 such that drawer slide assembly 100 will not open in the absence of a force applied to the drawer in direction 120.

Figure 11A:
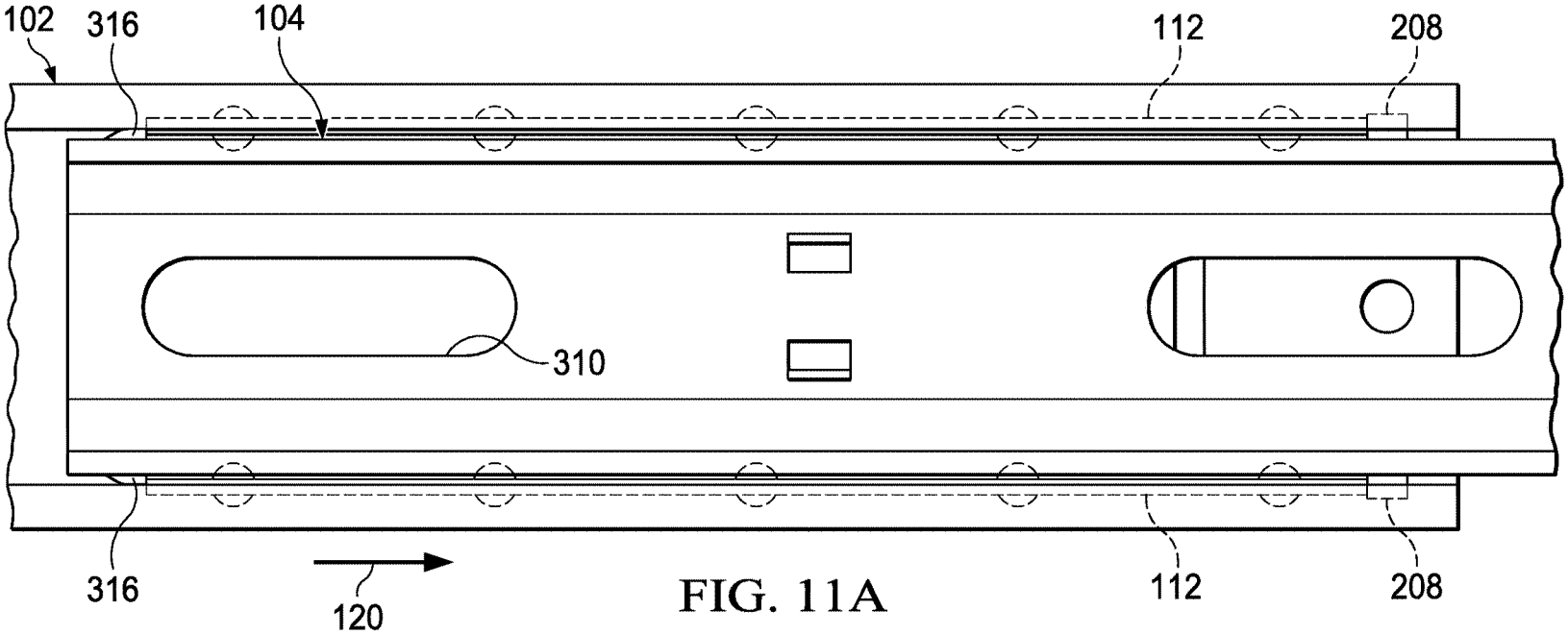
FIG. 11A is a partial plan view of a preferred embodiment the intermediate rail in a fully opened position relative to the cabinet rail.
Figure 11B:
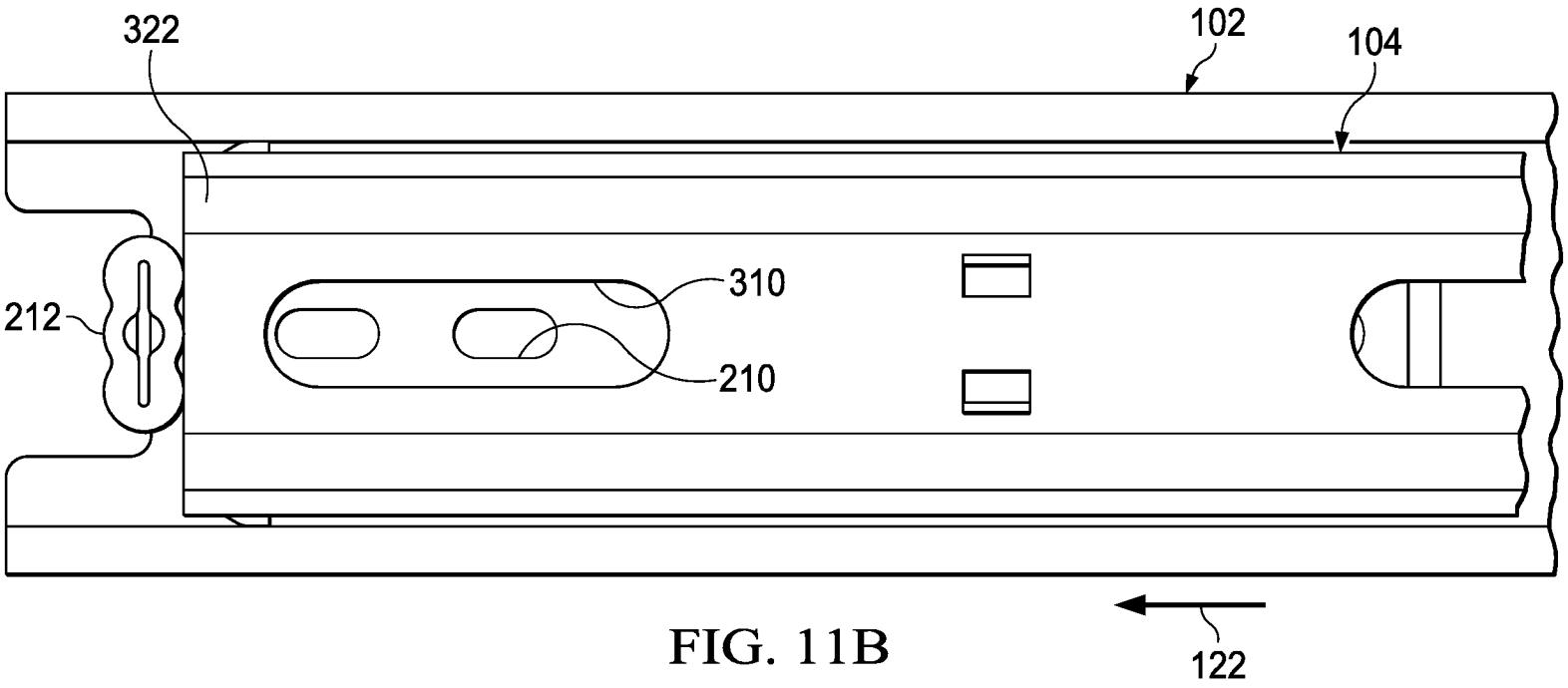
FIG. 11B is a partial plan view of a preferred embodiment the intermediate rail in a fully closed position relative to the cabinet rail.

The sliding motion of intermediate rail 104 relative to cabinet rail 102 is limited by end block 212, tabs 208, and stop tabs 316. As depicted in FIG. 11A, when opening, intermediate rail 104 slides in direction 120 until stop tabs 316 engage bearing runners 112 and bearing runners engage tabs 208. As shown in FIG. 11B, when closing, intermediate rail 104 slides in direction 122 until end 322 of intermediate rail 104 abuts end block 212. For ease of installation and removal of drawer slide assembly 100 from a cabinet carcass, intermediate rail 104 can be moved within cabinet rail 102 such that access holes 310 align with mounting holes 210, allowing tools such as screwdrivers and drills access to mounting holes 210 and any mounting hardware used to attach cabinet rail 102 to the cabinet carcass.

Figure 12A:
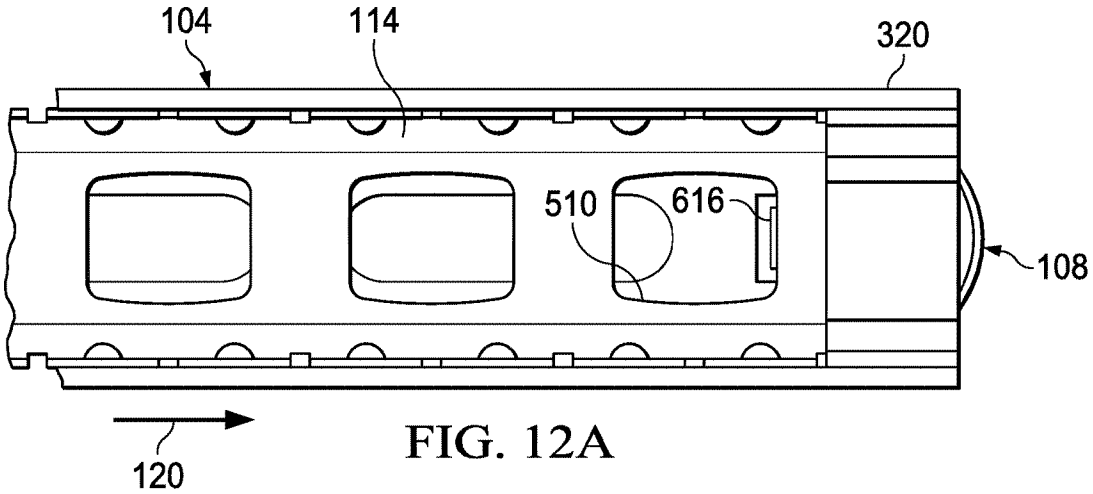
FIG. 12A is a partial plan view of a preferred embodiment the bearing cage in a fully opened position relative to the intermediate rail.
Figure 12B:
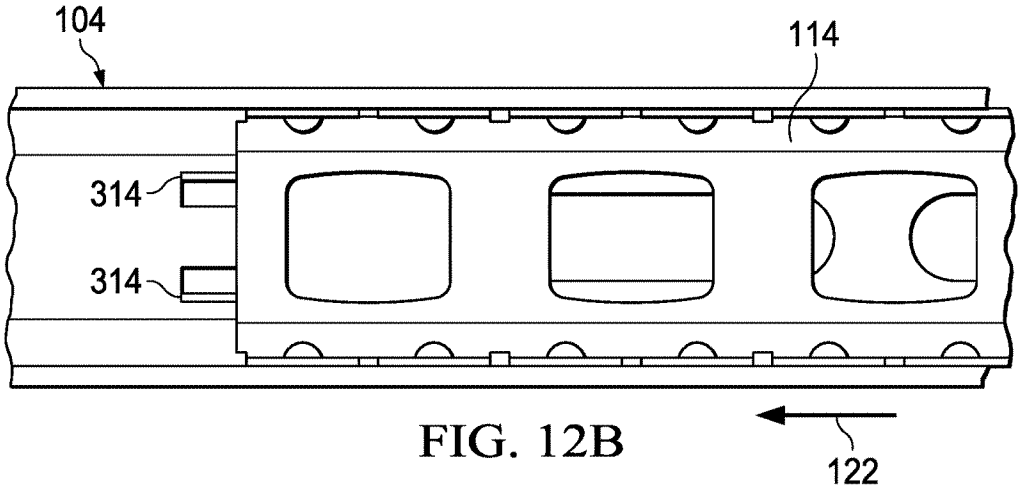
FIG. 12B is a partial plan view of a preferred embodiment the bearing cage in a fully closed position relative to the intermediate rail.

The sliding motion of bearing cage 114 relative to intermediate rail 104 is limited by cage hold forward device 108 and tabs 314. As depicted in FIG. 12A, when opening, bearing cage 114 slides in direction 120 until bearing cage 114 abuts cage hold forward device 108 attached to intermediate rail 104. Protrusion 616 extends from flexible clip 608 through hole 510 in bearing cage 114. As shown in FIG. 12B, when closing, bearing cage 114 slides in direction 122 until bearing cage 114 abuts tabs 314 extending from intermediate rail 104.

If it is desired to remove the drawer from the cabinet, the drawer and the attached drawer rail 106 can be removed from engagement with intermediate rail 104 without removing drawer slide assembly 100 from attachment to the cabinet carcass or drawer. During removal of drawer rail 106 from engagement with intermediate rail 104, cage hold forward device 108 situates bearing cage 114 in a forward position on intermediate rail 104 thus making reinsertion of drawer rail 106 within intermediate rail 104 easy and unencumbered.

Figure 13:
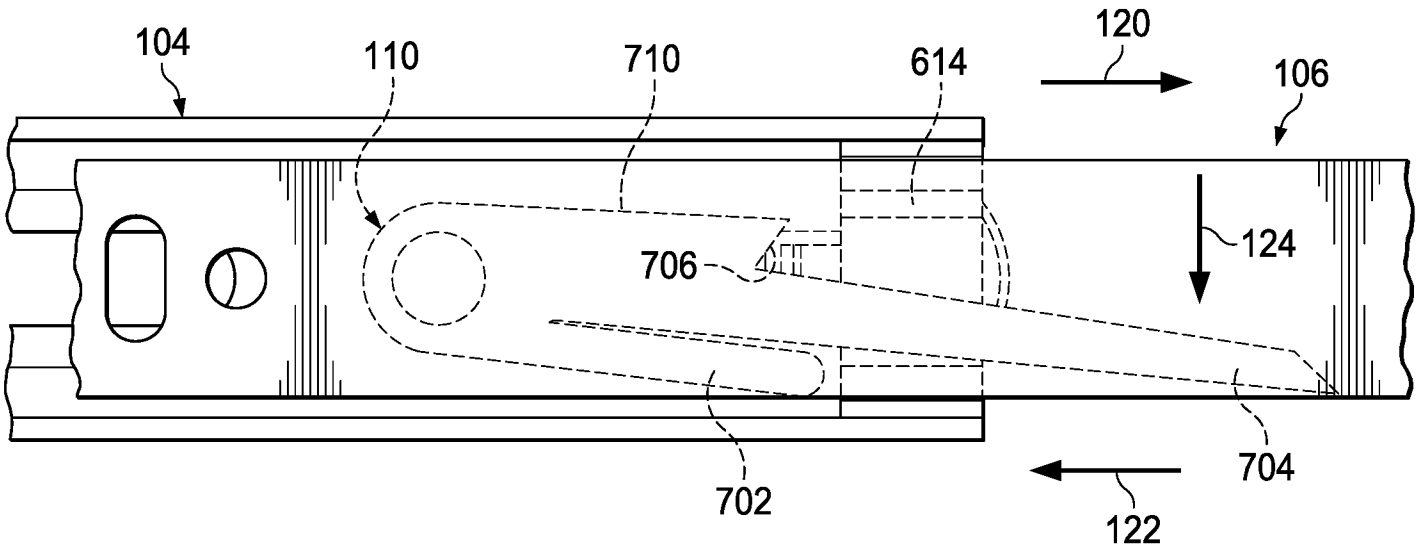
FIG. 13 is a partial plan view of a preferred embodiment the trigger bypassing the cage hold forward device.

As shown in FIG. 13, to remove the drawer rail from engagement with the intermediate rail, drawer rail 106 moves in opening direction 120 until trigger 110 engages block 614 of the cage hold forward device. Release arm 704 is pushed to one side in direction 124 bending flexible arm 702 until catch 706 bypasses block 614 allowing drawer rail 106 and the drawer to be removed from engagement with intermediate rail 104. The drawer rail pulls bearing cage 114 towards the cage hold forward device as the drawer is completely removed. As shown in FIG. 12A, flexible clip 608 of the cage hold forward device abuts the bearing cage, flexes at notch 618 while the bearing cage continues to slide in the opening direction, and snaps into engagement with the bearing cage as protrusion 616 engages the forward most hole 510 of the bearing cage. Cage hold forward device 108 holds the bearing cage at the forward end (end 320) of the intermediate rail such that upon re-insertion of the drawer into the cabinet, the drawer rail immediately engages the bearing cage to ease the re-insertion.

Upon reengagement of drawer rail 106 with intermediate rail 104, drawer rail moves in direction 122. Angled surface 710 abuts block 614 such that release arm 704 is pushed to one side in direction 124 against the bias of flexible arm 702 until catch 706 bypasses block 614 allowing drawer rail 106 to continue in closing direction 122. Bearing cage 114 moves with drawer rail 106 in direction 122 until bearing cage 114 abuts tabs 314.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

The invention claimed is:

1. A drawer slide assembly for releasable engagement of a drawer to a cabinet comprising:
- a cabinet rail telescopically engaged with an intermediate rail and configured to be attached to the cabinet;
- a drawer rail telescopically engaged with the intermediate rail and configured to be attached to the drawer;
- a bearing cage slidingly engaged between the intermediate rail and the drawer rail;
- a cage hold device attached to the intermediate rail;
- wherein upon removal of the drawer rail from engagement with the intermediate rail, the cage hold device releasably engages the bearing cage and holds the bearing cage at a forward position relative to the intermediate rail;
- wherein the cage hold device further comprises:
  - a mounting curve;
  - a body having a mounting bar extending between a set of edges, wherein the mounting bar and the mounting curve are sized and shaped to be engaged in a mounting hole of the intermediate rail; and,
  - a flexible clip extending from the body and releasably engaged with the bearing cage.

2. The drawer slide assembly of claim 1, wherein the cage hold device further comprises:
- the body fixedly engaged with the intermediate rail;
- a block extending from the body towards the drawer rail;
- wherein the drawer rail further comprises:
  - a flexible trigger pivotally attached to the drawer rail and abutting the block; and,
  - whereby pulling the flexible trigger allows the flexible trigger to bypass the block.

3. The drawer slide assembly of claim 1, further comprising:
- a flexible trigger pivotally mounted to the drawer rail and releasably engaged with the cage hold device.

4. The drawer slide assembly of claim 1, further comprising:
- an end block attached to the cabinet rail and releasably engaged with the drawer rail.

5. The drawer slide assembly of claim 1, further comprising:
- a set of bearing runners, containing a set of ball bearings, slidingly engaged between the cabinet rail and the intermediate rail, and,
- inner grooves, formed at curved edges of the intermediate rail, slidingly engaged with the set of ball bearings.

6. The drawer slide assembly of claim 1, further comprising:

a set of stop tabs extending from the intermediate rail towards the cabinet rail;

a set of tabs extending from the cabinet rail; and, a set of bearing runners slidingly engaged between the cabinet rail and the intermediate rail and abutting the set of stop tabs and the set of tabs.

7. The drawer slide assembly of claim 1, further comprising:

a set of tabs extending from the intermediate rail; and, wherein the bearing cage is slidable along the intermediate rail between the set of tabs and the cage hold device.

8. The drawer slide assembly of claim 1, further comprising:

a set of pinch arms extending from the drawer rail; and, an end block attached to the cabinet rail and releasably engaged with the set of pinch arms.

9. A method for positioning a bearing cage in a forward position of a drawer slide assembly comprising:

providing a drawer slide assembly comprising a cabinet rail, a telescopic intermediate rail, and a telescopic drawer rail;

providing a bearing cage slidingly engaged between the intermediate rail and the drawer rail;

providing a cage hold device fixedly attached to the intermediate rail;

providing a trigger pivotally attached to the drawer rail;

moving the drawer rail in an opening direction;

moving the intermediate rail in an opening direction;

abutting the cage hold device with the trigger;

flexing the trigger to bypass the cage hold device;

pulling the bearing cage towards the cage hold device with the drawer rail;

releasably engaging the bearing cage with the cage hold device;

disengaging the drawer rail from the bearing cage;

wherein the step of releasably engaging the bearing cage with the cage hold device further comprises:

providing a mounting curve;

providing a flexible clip extending from the cage hold device and a set of holes in the bearing cage;

engaging the mounting curve with a curved forward edge of the intermediate rail; and, engaging the flexible clip with a forward most hole of the set of holes.

10. The method for positioning a bearing cage of claim 9, wherein the step of releasably engaging the bearing cage with the cage hold device further comprises:

providing a protrusion extending from the flexible clip and a notch in the flexible clip disposed opposite of the protrusion;

flexing the flexible clip at the notch; and, engaging the protrusion with the forward most hole of the set of holes.

11. The method for positioning a bearing cage of claim 9, further comprising:

reengaging the drawer rail with the bearing cage;

moving the intermediate rail in a closing direction;

moving the drawer rail in the closing direction;

abutting the cage hold device with the trigger; and, flexing the trigger to bypass the cage hold device.

12. The method for positioning a bearing cage of claim 9, wherein the step of abutting the cage hold device with the trigger further comprises:

providing a block extending from the cage hold device; and, abutting the block with the trigger.

13. The method for positioning a bearing cage of claim 9, wherein the step of flexing the trigger to bypass the cage hold device further comprises:

providing the trigger includes providing a flexible arm disposed from a release arm;

moving the release arm; and, bending the flexible arm.

14. The method for positioning a bearing cage of claim 9, wherein the step of flexing the trigger to bypass the cage hold device further comprises:

providing a catch extending from the release arm engaged with a block extending from the cage hold device; and, disengaging the catch from the block.

* * * * *